United States Patent [19]

Faasse

[11] Patent Number: 4,687,030

[45] Date of Patent: Aug. 18, 1987

[54] HEDDLE FRAME FOR A HIGH SPEED WEAVING MACHINE

[75] Inventor: Gene E. Faasse, Taylors, S.C.

[73] Assignee: Steel Heddle Manufacturing Co., Greenville, S.C.

[21] Appl. No.: 896,980

[22] Filed: Aug. 14, 1986

[51] Int. Cl.[4] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 4,015,639 | 4/1977 | Koch | 139/92 |
| 4,022,252 | 5/1977 | Ogura . | |
| 4,230,159 | 10/1980 | Shimizu . | |
| 4,249,579 | 2/1981 | Baumann et al. | 139/92 |
| 4,349,052 | 9/1982 | Yaji et al. | 139/92 |

FOREIGN PATENT DOCUMENTS

| | | | |
|---|---|---|---|
| 446221 | 3/1968 | Switzerland | 139/91 |

*Primary Examiner*—Henry S. Jaudon

*Attorney, Agent, or Firm*—Julian W. Dority

[57] ABSTRACT

A heddle frame having a pair of hollow laterally extending cross rails and a pair of end braces connected to adjacent ends of said cross rails to form a rectangular frame. The connection between the end braces and the laterally extending cross rails comprise a projection which extends at right angles from the end brace and fit into an elongated opening within the hollow cross rails. The projection has a width which is less than the width of a opening into which it extends and includes means for resiliently connecting the projection to the walls of the hollow rail to provide a connection between the end brace and the cross rail which is rigid when not under stress but permits limited relative movement between the cross rails and the end brace whenever the cross rails are under stress. The resilient connection includes an insert of a synthetic plastic, elastomeric material such as polyurethane into which is fitted two or more bushings for the reception of metal fastener means which fastens the insert securely to the walls of the hollow cross rail.

9 Claims, 6 Drawing Figures

Fig. 1.
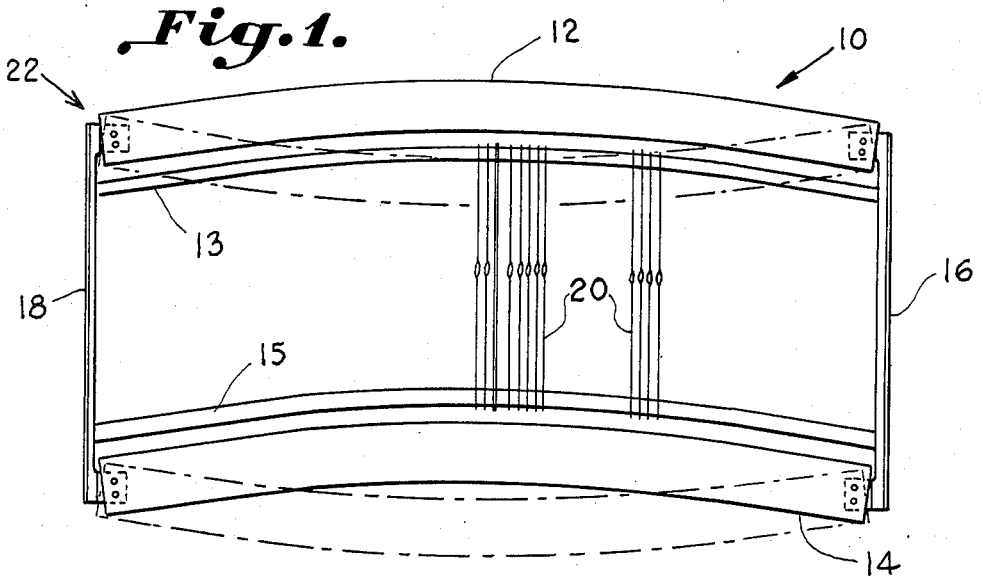
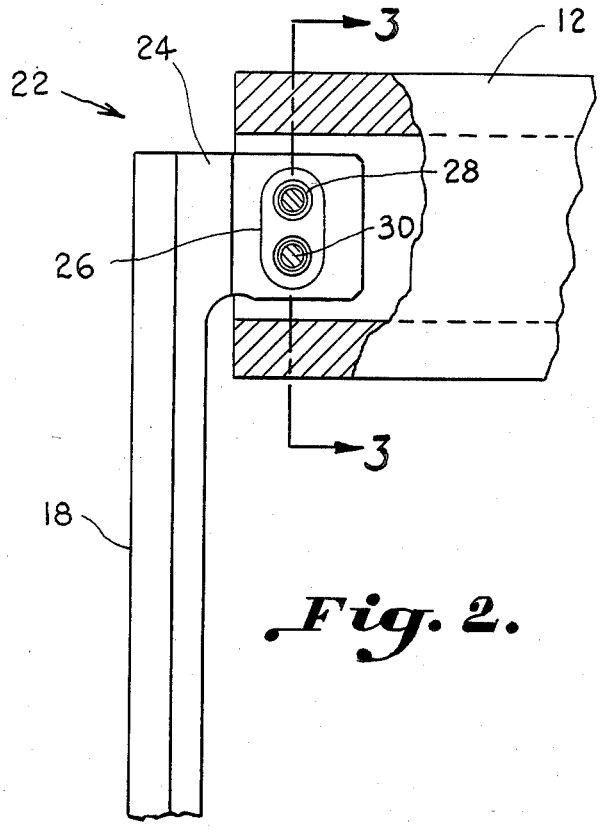
Fig. 2.
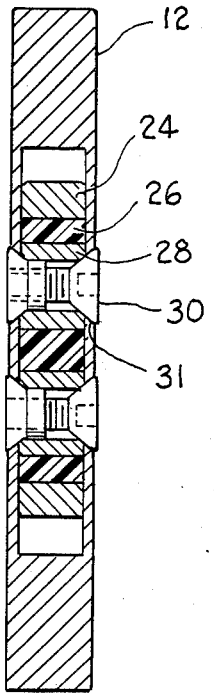
Fig. 3.

HEDDLE FRAME FOR A HIGH SPEED WEAVING MACHINE

BACKGROUND OF THE INVENTION

The present invention relates to high speed weaving machines and more particularly, to the heddle frames for use on high speed weaving machines.

In the past, heddle frames used in weaving machines were composed of a pair of end braces and a pair of laterally extending rails. The end braces were conventionally, rigidly attached to the top and bottom rails at each end. The end braces are free to slide in a guiding groove on a support on the weaving machine to form the shed during the weaving operation. With the advent of high speed weaving machines, which make as many sheds as 300 to 600 per minute, the reciprocating motion of the heddle frame was very rapid and the inertia of the heddle frame, owing to its weight, was very great. This caused frequent breaking of the heddle frames, particularly at the connection between the end braces and the top and bottom rails.

In an attempt to overcome such defects and to reduce the inertia of the heddle frame, the top and bottom rails have been made of light weight hollow aluminum beams. However, the aluminum rails are subjected to substantial bending which exerts a flexing movement of the connection between the end brace and the top and bottom rail. This flexing action results in fatigue of the metal comprising the end braces or the rails or both, thereby causing frequent failure of the heddle frame.

Several attempts have been made to overcome the problems created by the high speed weaving machines. One such attempt is shown in U.S. Pat. No. 4,022,252 issued May 10, 1977 to Hiroshi Ogura. In this patent, the end brace has a metal core, a portion of which is covered with plastic to provide additional strength. A pair of joining pieces project from the strengthened portion of the core of the end brace, as one body and form a tapered groove therebetween. These projections extend into the hollow body of the cross rails. The end brace is anchored to the cross rails by means of a wedged shaped member which is attached to the end brace by screws. The wedged shaped member enters the tapered groove, formed by the projecting pieces, so as to force the projecting pieces against the side walls of the cross rail, locking the end brace firmly to the cross rails. This joint is relatively rigid in that the projected pieces are firmly forced against the walls of the cross rail and provides little or no flexibility between the end brace and the cross rails. This arrangement makes for a stronger connection between the end brace and the cross rails but does not provide for the flexibility of the connection which is necessary to avoid unduly flexing or fatiguing the metal making up the end braces or the cross rails.

Another attempt to resolve the defects and deficiencies of the prior art heddle frames is shown in U.S. Pat. No. 4,230,159 issued Oct. 28, 1980 to Yoichi Shimizu. In this patent, the end brace is joined to the cross rail by means of a plastic projection which extends into the hollow space of a cross rail and is pinned to the cross rail by a single pin which permits the projection to pivot about the pin to provide for a flexible joint. A packing material 11 is packed between the space between the end brace and the cross rail to dampen the noise or pivoting action between the end brace and cross rail. This permits the flexibility of the joint but it is a design that cannot be readily disassembled for drawing in of the warps or for replacing component parts.

SUMMARY OF THE INVENTION

Accordingly, it is an object of the present invention to provide an improved heddle frame having a simplified connection between the cross rail and the end brace.

Another object of this present invention is to provide an improved heddle frame which has resistance to cutting and breaking the connection between the end brace and the cross rail, caused by the bending of the metal and fatiguing of the metal.

Another object of this present invention is to provide a heddle frame which is quickly and easily disassembled for repairs or for drawing in new warps into the heddle eyes.

Yet another object of the invention is to provide a heddle frame which has a rigid but flexible connection between the end braces and the top and bottom rails and which will permit relative movement between the end brace and the rails without bending the rails or the end braces.

BRIEF DESCRIPTION OF THE DRAWINGS

Other objects of the present invention will be more fully appreciated as the same becomes better understood from the following detailed description of the present invention, when considered in connection with the accompanying drawings, wherein like referenced characters designate like or corresponding parts, and in which:

FIG. 1 is a front view of a heddle frame of a high speed weaving machine according to the present invention;

FIG. 2 is an enlarged front view, partially in section, illustrating the connection between the end brace and the top cross rail; and FIG. 3 is a sectional view taken line 3—3 of FIG. 2;

DETAILED DESCRIPTION

Figure 4:
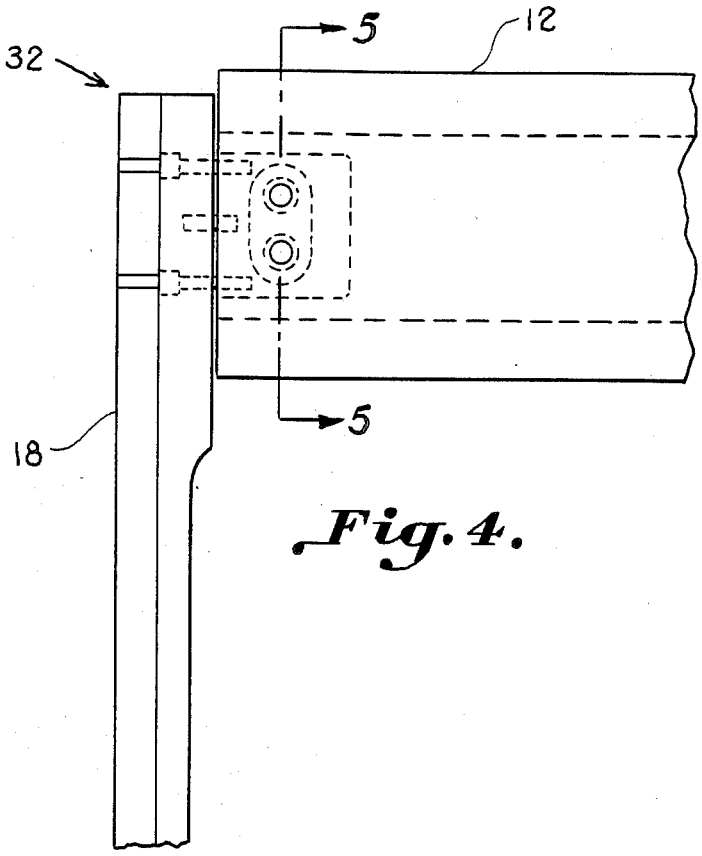
FIG. 4 is an enlarged front view showing a second embodiment of the connection between the end brace and the top rail.

Referring now to FIG. 1 of the drawings, a heddle frame 10 is shown being composed of a pair of cross rails 12 and 14 and a pair of end braces 16 and 18. Cross rails 12 and 14, respectively, carry heddle bars 13 and 15 on which are mounted a plurality of heddles 20. The cross rails are formed of a hollow aluminum beam and the end braces have projections which extend into the hollow aluminum cross rails for connection thereto. As seen in FIG. 1, cross rails 12 and 14 are subjected to substantial distortion during the operation of the weaving machine as noted by the full line and the dotted line positions of the cross rails. The bending of the cross rails exerts considerable stress onto end braces 16 and 18 and particularly, upon the connection between the cross rails and the end braces.

FIGS. 2 and 3 illustrate a first embodiment of the connection between the end brace and the cross rail. In this embodiment, a connection 22 is made between a footed projection 24 which in integral with end brace 18. It is to be understood that end braces 16 and 18 are provided with a footed projection for each of the cross rail connections. Projection 24 is made of the metal and is integral with the end brace. However, projection 24 has an insert 26 of a synthetic elastomeric material such as polyurethene, nylon or the like, which is force fit into an opening within the projection. Two bushings or sleeves 28 are located within the synthetic insert for the reception of metal fasteners 30. Fasteners 30, as shown in FIG. 3, comprise threaded bolts which extend through holes 31 in cross rail 12 and through bushing 28 and nuts and thereby holding projection 24 in the center of the hollow opening or space in rail 12. It is especially important to note that projection 24 is narrower than the width of the hollow in cross rail 12. When using the terms "narrower" and "width" with respect to projection 24 and the cross rail 12, reference is had to the heights of the projection and the hollow space as seen in FIG. 2 of the drawings. This is necessary to permit limited relative motion between end brace 18 and cross rail 12 to be absorbed by the synthetic elastomeric material of insert 26.

Figure 5:
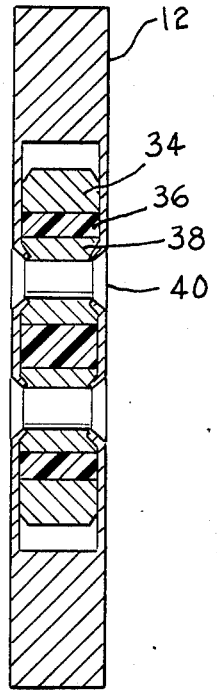
FIG. 5 is a sectional view taken along line 5—5 of FIG. 4.
Figure 6:
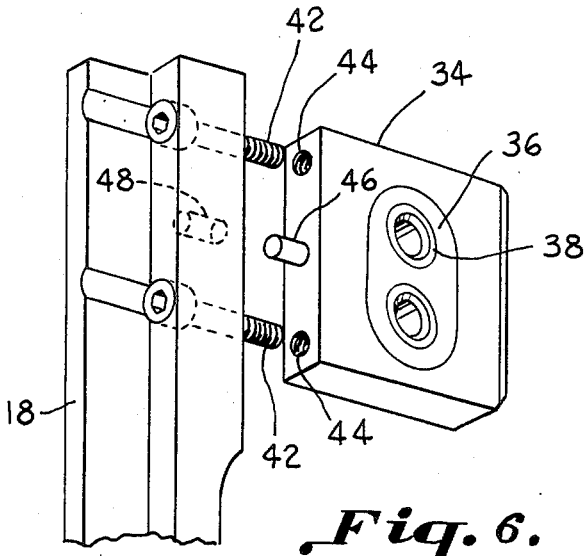
FIG. 6 is an exploded perspective view of the end brace shown in FIG. 4.

Referring now to FIGS. 4, 5 and 6, wherein a second embodiment of the connection between the end brace and the cross rails is shown, in this embodiment, connection 32 comprises a removable projection 34 which is attached to the end brace 18 by threading bolts 42 which are threaded with end force 44. To add rigidity, a pin or dowel 46 is fitted within a bore in the projection and also within bore 48 in end brace 18.

In this embodiment, projection 34 is substantially the same as projection 24 of the first embodiment in that it is force fitted with an insert 36 of a synthetic elastomeric material such as polyurethene, which in turn contains two bushings 38 for the reception of a metal fastener 40, which in this embodiment is shown to be rivets. Thus, rivets 40 extend through openings or holes 41 in the cross rail and thereby rigidly connect the projection to the cross rail. Whenever it is necessary to disconnect the cross rail from the end brace, it is accomplished quickly and easily by unscrewing bolts 42. As in the embodiment of FIGS. 2 and 3, the width of projection 34 is less than the width of the hollow within cross rail 12, thereby permitting relative movement between end brace and cross rail 12 whenever cross rail 12 is deflected or bent under stress of weaving. Thus, the synthetic insert included in the projection, in each case, absorbs the stress of the cross rail bending without flexing or bending the metal end brace and thereby avoiding fatiguing and rupturing the metal of the end brace.

Two embodiments of the invention have been illustrated and described, however, it will be readily apparent to those skilled in the art that other variations of the structure shown herein could be made without departing from essential features of the invention. It is therefore to be understood that within the scope of the appended claims, the invention may be practiced otherwise than as specifically described herein.

What is claimed to be new and desired to be secured by Letters Patent of the United States:

1. In a heddle frame having a pair of laterally extending cross rails and a pair of end braces connected to adjacent ends of said pair of cross rails to form a rectangular frame, wherein each of the connections between said end braces and said laterally extending rails comprise:

(a) an elongated opening within the end of said cross rails;

(b) a projection extending laterally from said end brace, into said opening in the cross rail, wherein the width of said projection is less than the width of said opening; and (c) means to resiliently connect said projection to the side walls of the cross rail into which it extends, to provide a connection which is rigid when not under stress but which has limited flexibility to permit limited vertical movement of the cross rails relative to the end braces whenever the cross rails are under vertical stress.

2. In a heddle frame as set forth in claim 1 wherein each of said projections comprises a rigid metal member with a rigid resilient insert of a synthetic material which is attached to said rail.

3. In a heddle frame as set forth in claim 2 wherein each of said inserts is provided with at least two bushings, through which extend metal fasteners for rigidly connecting said bushings to said cross rail.

4. In a heddle frame as set forth in claim 2, 3, or 1 wherein said projection is formed integrally with said end brace.

5. In a heddle frame as set forth in claim 2, 3, or 1 wherein said projection is attached to the end brace by threaded bolt means.

6. A heddle frame for a high speed weaving machine comprising:

(a) a metal end brace having a projection at a 90° angle from the longitudinal axis of said end brace;

(b) a metallic cross rail having an opening therein for receiving said projection, wherein the width of the opening within the cross rail is greater than the width of the projection; and (c) means to resiliently connect said projection to the side walls of the cross rail at the opening into which it extends, to provide a connection which is rigid when not under stress but which has limited flexibility to permit limited vertical movement of the cross rail relative to the end brace whenever the cross rail is under vertical stress.

7. A heddle frame as set forth in claim 6 wherein the projection is provided with a resilient insert of a synthetic polimeric material in which are disposed at least two metallic bushings and metal fastening means for securing said insert to the walls of said hollow cross rail.

8. In a heddle frame as set forth in claim 7 or 6 wherein said projection is formed integrally with said end brace.

9. In a heddle frame as set forth in claim 7 or 6 wherein said projection is attached to the end brace by threaded bolt means.

* * * * *